United States Patent [19]

Finkelstein et al.

[11] Patent Number: 4,793,579

[45] Date of Patent: Dec. 27, 1988

[54] TABLE LEG MOUNTING SOCKET

[75] Inventors: Burl Finkelstein, Shenandoah; Mel Lehto, Newnan, both of Ga.

[73] Assignee: Kason Industries, Inc., Shenandoah, Ga.

[21] Appl. No.: 155,992

[22] Filed: Feb. 16, 1988

[51] Int. Cl.[4] ..... F16M 11/16

[52] U.S. Cl. ..... 248/188

[58] Field of Search ..... 248/188, 165, 188.8; 108/156; 297/440; 403/230

[56] References Cited

U.S. PATENT DOCUMENTS

| | | | |
|---|---|---|---|
| 2,608,455 | 8/1952 | Paden | 248/188 |
| 2,873,987 | 2/1959 | Larson | 248/188 |
| 3,032,375 | 5/1962 | Lalandre | 248/188 |
| 3,041,708 | 7/1962 | Holtz | 248/188 |
| 3,066,992 | 12/1962 | Larson | 248/188 |
| 3,322,384 | 5/1967 | Rodwell | 248/188 |
| 3,865,050 | 2/1975 | Cecchetti | 248/188 |

FOREIGN PATENT DOCUMENTS

| | | | |
|---|---|---|---|
| 1218378 | 12/1959 | France | 248/188 |

*Primary Examiner*—J. Franklin Foss
*Assistant Examiner*—Robert A. Olson
*Attorney, Agent, or Firm*—Thomas & Kennedy

[57] ABSTRACT

A socket for use in mounting a cylindrical leg to a table is comprised of a tube that has a generally cylindrical wall one end of which is inwardly flared to form a circular lip of a selected inside diameter substantially equal to the outside diameter of the leg. The generally cylindrical wall is formed with at least three inwardly projecting ribs that the located tangentially about a geometric cylindrical boundary of the same diameter as the selected inside diameter of the wall end lip.

10 Claims, 1 Drawing Sheet

TABLE LEG MOUNTING SOCKET

TECHNICAL FIELD

This invention relates to sockets of the type used to mount table legs.

BACKGROUND OF THE INVENTION

In the food processing industry tables are commonly constructed of stainless steel to render them sanitary. These tables commonly have one or more tops or shelves that are supported by four or more upright legs. The legs are usually of tubular construction and are secured beside or to the bottom of the shelves by leg mounting sockets.

Heretofore, as exemplified by those sold by Kason Industries, Inc. of Shenandoah, Ga., these sockets have been in the form of stainless tubes or shells which have a lower end flared inwardly and an upper end flared outwardly. The lower end is flared inwardly to provide a smooth, continued bottom lip to inhibit fluids from collecting there. By flaring and rounding the end of the socket, liquids will flow easily from the bottom of the socket directly onto the table leg and thereby provide for good drainage. By flaring the upper end of the socket outwardly, an annular flange is created that can be welded to the bottom of a table top. For mounting legs beside a shelf, both ends of the socket are inwardly flared.

Though inwardly flaring or tapering the bottom end of table leg sockets solves one problem, it does create another. Specifically, it causes the inside diameter of the bottom of the socket to be smaller than the remainder of the socket. Were this condition to be left in tact, a cylindrical leg would tend to wobble about within the socket. To avoid this from occurring, a mild steel inner liner has had to be inserted snuggly inside the socket shell to provide a leg engaging surface of the same diameter as that of the inturned bottom end. As a result, most of the leg mounted within the socket is in snug engagement with the socket so that it is not free to wobble or to assume a canted angle with respect to the socket shell.

Though leg sockets of the type just described have functioned well with the inclusion of the mild steel liner, the liner has served to maintain the cost of manufacturing these type of leg sockets relatively high. In addition, the presence of the liner has rendered the sockets relatively heavy and has created the potential for rust bleed-outs to occur. Plastic liners have been tried as a substitute for the more expensive and heavy, mild steel liner. They, however, have failed to provide lasting rigidity sufficient to prevent leg canting from occurring.

If a leg mounting socket of the type having an inwardly flared end could be deviced which did not require the presence of an inner liner to maintain a leg centered and in secure gripping engagement within the socket, a distinct advance in the art would be achieved. It is to the provision of such therefore that the present invention to primarily directed.

SUMMARY OF THE INVENTION

In one form of the invention a socket is provided for use in mounting a cylindrical leg to a table or the like. The socket is comprised of a tube that has a generally cylindrical wall one end of which is inwardly flared to form a circular lip of a selected inside diameter that is equal to the outside diameter of the leg. The cylindrical wall is formed with at least three inwardly projecting ribs located substantially tangently about a geometric cylindrical boundary of the same diameter as the selected inside diameter of the wall end lip.

In another preferred form of the invention a socket is provided for use in mounting a cylindrical leg to a top or shelf of a table to be supported by the leg. The socket comprises a metallic tube that has a generally cylindrical wall with one wall end being inwardly flared to form a circular lip. The cylindrical wall is also formed with at least three indentations that extend inwardly to spacial positions located along a cylindrical geometric boundary that extends coaxially through the tube from the lip. With the socket so constructed, a cylindrical leg may be mounted within the socket in supported contact with both the socket lip and the indentations.

DETAILED DESCRIPTION

Figure 1:
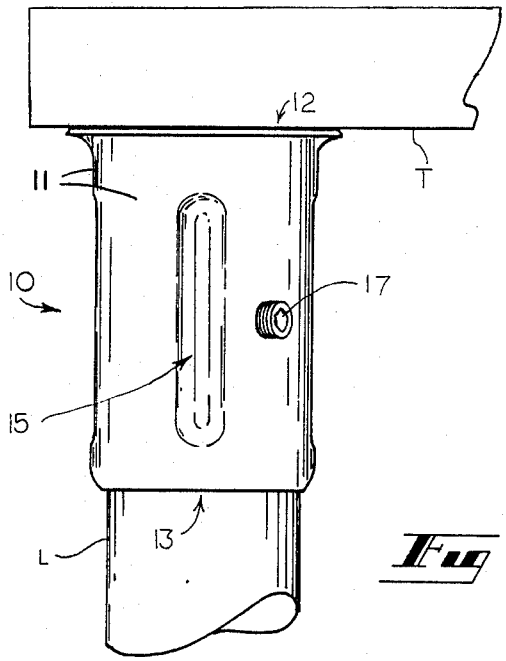
FIG. 1 is a side elevational view of a socket constructed in accordance with principles of the invention shown mounted to a table.

With reference next to the drawing, there is shown a socket indicated generally at 10 for mounting a cylindrical leg L to a table top T. The socket is comprised of a stainless steel tube or shell having a generally cylindrical wall 11 that terminates with an upper, open end 12 and a lower, open end 13. The upper end is flared outwardly to form an annular, generally flat ledge or flange 14. Conversely, the lower end 13 is flared inwardly to have an inside diameter D which is substantially equal to the outside diameter of the cylindrical leg L.

Figure 2:
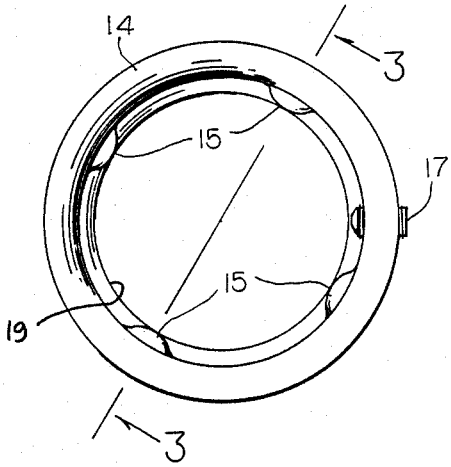
FIG. 2 is a plan view of the socket illustrated in FIG. 1 shown detached from the table.
Figure 3:
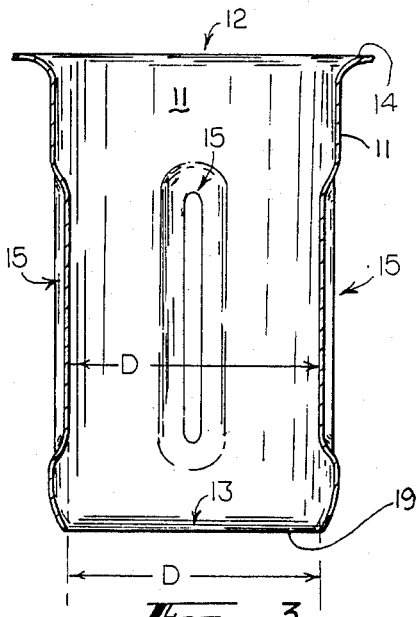
FIG. 3 is a side view, in cross-section, taken along plane 3—3 of the socket illustrated in FIG. 2.

The wall 11 here is formed with at least three equally spaced, elongated indentations or ribs 15. In the embodiment shown the socket has four ribs. Each rib extends in an axial direction and has a length somewhat greater than half the spacing between the two wall ends 12 and 13. The ribs 15 extend inwardly a distance to a point where their inside surfaces pass tangently to a geometric cylindrical boundary that extends coaxially through the wall 11 from the lip 19 of the wall end 13, as indicated by the broken lines. This is shown most clearly in FIG. 2 where it is seen that the apogee of the indentation coincides with the inner edge of lip 19. Thus, opposing located indentations or ribs 15 are spaced apart a distance D that equals the inside diameter D of the lip 19. The socket also has a set screw 17 which is threadedly received in a hole located in the wall 11 between two adjacent ribs 15.

The socket 10 is easily manufactured by cutting a tube blank of stainless steel and then swaging in the bottom end 13 to form the lip 19. An hydraulic ram is used to press in the indentations or ribs 15. The open end 12 is flared outwardly by pressing it against a conical mandrel. Where the socket is to be used to mount a leg to a side edge or corner of a shelf, both open ends of the wall 11 are flared inwardly to prevent a build-up of liquids upon each end of the socket.

For use the socket 10 may be mounted to a table top T by welding the flange 14 to the flat bottom surface of the top T. A leg L is then inserted into the socket and butted up against the table top. The set screw 17 is then tightened against a side of the leg.

It thus is seen that a table leg socket is now provided which does not require the use of an inside liner. The new socket may be of a unitary, stainless steel structure. Thus, it is less costly to manufacture, both from a materials and a labor viewpoint, and is lighter in weight than those of the prior art.

It should be understood that the just described embodiment merely illustrates principles of the invention in a preferred form. Many modifications, additions, and deletions may, of course, be made thereto without departure from the spirit and scope of the invention as set forth in the following claims.

We claim:

1. A socket for use in mounting a cylindrical leg to a table or the like, and with the socket being comprised of a tube having a generally cylindrical wall one end of which is inwardly flared to form a circular lip of a selected inside diameter substantially equal to the outside diameter of the leg, and wherein said generally cylindrical wall is formed with at least three inwardly projection ribs located substantially tangentially about a geometric cylindrical boundary of the same diameter as said selected inside diameter of said wall end lip.

2. The socket of claim 1 wherein said tube cylindrical wall has another end which is outwardly flared to from a mounting flange.

3. The socket of claim 1 wherein said cylindrical wall is of a selected length, and wherein each of said ribs has a length half of said selected wall length.

4. The socket of claim 1 wherein said socket is of a unitary metallic structure.

5. The socket of claim 1 further comprising a set screw threadedly mounted to said cylindrical wall between two of said ribs.

6. A socket for use in mounting a generally cylindrical leg to a table top or shelf to be supported by the leg, and with the socket comprising a metallic tube having a generally cylindrical wall with at least one wall end being inwardly flared to form a circular lip, and wherein said generally cylindrical wall is formed with at least three indentations that extend inwardly to spacial positions located substantially along a cylindrical geometric boundary that extends coaxially through said tube from said lip, whereby a cylindrical leg may be mounted within said socket in supported contact with both the socket lip and the indentations.

7. The socket of claim 6 wherein said cylindrical wall has a second end that is outwardly flared.

8. The socket of claim 7 wherein said indentations are elongated and extend in a direction from said one wall end towards said second wall end.

9. The socket of claim 8 wherein each of said elongated indentations has a length of at least half the length of said generally cylindrical wall.

10. The socket of claim 9 further comprising a set screw threadedly mounted to said cylindrical wall between two of said elongated indentations.

* * * * *